US008839729B2

(12) United States Patent
Ganz

(10) Patent No.: US 8,839,729 B2
(45) Date of Patent: Sep. 23, 2014

(54) HALYARD RETRIEVAL DEVICE APPARATUS AND METHOD

(71) Applicant: Jonathan Ganz, Orangevale, CA (US)

(72) Inventor: Jonathan Ganz, Orangevale, CA (US)

( * ) Notice: Subject to any disclaimer, the term of this patent is extended or adjusted under 35 U.S.C. 154(b) by 167 days.

(21) Appl. No.: 13/714,194

(22) Filed: Dec. 13, 2012

(65) Prior Publication Data

US 2014/0165895 A1 Jun. 19, 2014

(51) Int. Cl.
*B63H 9/04* (2006.01)
*B63H 9/10* (2006.01)

(52) U.S. Cl.
CPC ..... *B63H 9/10* (2013.01); *B63B 2231/30* (2013.01)
USPC ..... 114/111; 114/112; 114/114

(58) Field of Classification Search
CPC ..... B63B 15/02; B63H 9/10; B29C 70/20
USPC ..... 114/111–112, 114
See application file for complete search history.

(56) References Cited

U.S. PATENT DOCUMENTS

| | | | | |
|---|---|---|---|---|
| 3,830,182 | A * | 8/1974 | Pattison, III | 114/114 |
| 5,738,031 | A * | 4/1998 | Malina | 114/102.1 |
| 6,347,462 | B1 * | 2/2002 | Steinich | 33/756 |
| 2009/0217713 | A1 * | 9/2009 | Loughlin et al. | 70/53 |
| 2009/0226050 | A1 * | 9/2009 | Hughes | 382/124 |
| 2014/0165895 | A1 * | 6/2014 | Ganz | 114/111 |

* cited by examiner

*Primary Examiner* — Lars A Olson
*Assistant Examiner* — Jovon Hayes

(57) ABSTRACT

The apparatus and method of the present invention provide a crewmember with the ability to retrieve the halyard and shackle at the head of a mast of a contemporary sailing vessel from the deck. A clamshell device containing a magnetized component is pre-installed on the halyard shackle and a related magnetically active cylinder is attached to a companion non-loaded halyard running just beside the loaded halyard. The clamshell is attached at the top of the shackle just below the halyard that is attached to the shackle.

20 Claims, 6 Drawing Sheets

HALYARD RETRIEVAL DEVICE APPARATUS AND METHOD

This non-provisional utility patent application claims the benefit under 35 USC 119(e) of provisional application 61/630,487 filed Dec. 29, 2011.

The subject of this invention relates to sailing vessels and related rigging. Specifically, the disclosed invention presents an apparatus and method for its use that facilitates retrieval of unattached halyards of a sailing vessel without the need for a crewmember to ascend the mast, thereby eliminating the risk and expense associated with such activity.

BACKGROUND OF THE INVENTION

Sailing vessels have existed for centuries. While modern sailing vessels have taken advantage of the progress made in materials and methods science, the fundamental operation of a sailing vessel remains the same. That is, depending on wind conditions and direction, a sail or sails must be raised, lowered, or trimmed to optimize the performance of the craft. Most modern sailboats have at least two sails that are used and typically have additional halyards included for spares and for specialty sails.

Modernly, as in historical times, sails are raised and lowered via a system of lines or halyards attached to the heads of sails. For clarity, the head of the sail is the top most portion of a triangular sail, which is the most common shape for modern sailboats. The halyard is attached to sail with a clasping device typically called a shackle having a curved and enclosed top and an open section with a pin that is placed through a metal or plastic grommet or cringle at the head of the sail. The top most portion of the shackle is used to attach the halyard.

Since the marine environment is corrosive to high zinc alloys (and other ferrous metals), shackles and most marine hardware is either 316 grade stainless steel, plastic, carbon fiber or similar material. Such marine hardware serves several purposes, and for purposes of the present invention, it is only noted here that such hardware in addition to the shackle does exist.

If a shackle should accidentally become disconnected from a sail, for example, if the pin holding the sail cringle is dislodged, the shackle will be difficult to retrieve since the wind will tend to move the shackle away from the vessel or the weight of the opposite end of the line will bring the shackle to the top of the mast. In fact, at present, the only practical way to retrieve the shackle for reattachment is to either ascend the mast and manually retrieve it or try to fashion some sort of snagging device. In the first case, this involves either a crewmember hoisting themselves aloft, a crewmember being hoisted aloft by another, or using pre-installed mast steps. In the second case, this involves multiple lines whipping around with a crewmember trying to snag it. Both of these situations are dangerous and time consuming operations.

In the case of the first contemporary method, if a crewmember wishes to hoist themselves aloft, products such as the TopClimber from ATN, Inc., Hollywood, Fla., may be used. This device allows a crewmember to place each foot in a loop and, using upper body strength and alternate foot movement, slowly pull themselves to the head of the mast.

Alternatively, a classic "bosun's chair" may be used. For this method, the crewmember sits in a seat and is pulled aloft by one or more other crewmembers. It is possible for a single crewmember to use the chair method, but it is difficult and requires significant strength.

A third contemporary method for ascending the mast is to use pre-installed steps, either fixed or folding, such as the folding mast step from Sea Dog, Everett, Wash. In this method the mast has had a set of folding steps permanently attached to the sides of the mast. When required for maintenance, the steps are folder outward and the crewmember climbs aloft a step at a time. When the crewmember descends, each step is folded inward to prevent fowling of other rigging.

In the case of the snag method, a crewmember uses a weighted grappling hook with one or more tines, casting the device upward to retrieve the unattached shackle. Of course, this method has some very dangerous and damaging side effects. For example, if the device fails to retrieve the unattached shackle it will necessarily fall back to the deck causing damage to the boat and/or other crewmembers.

Each of the above methods has its drawbacks. For each, one or more crewmembers are put at risk of injury due to falling, tangling or other physical failure modes. Additionally, damage to the craft itself is likely if the snag method is attempted. Beyond the danger, because all present methods use the existing halyard system, the crewmember can have trouble reaching the actual masthead to accomplish the retrieval.

While the step method seems to be satisfactory, it involves expense and has the severe drawback of creating a potential interference to the running rigging when the vessel is underway. In addition, snagging a line either from the deck or at the masthead involves similar drawbacks. Also, with all methods, while relatively easy to accomplish at dockside or while anchored in calm waters, neither can be used safely while under way or in rough water.

What would be desirable would be an apparatus and method that would allow a single crewmember to accomplish the retrieval task from the safety of the deck.

SUMMARY OF THE INVENTION

The apparatus and method of the present invention provide a crewmember with the ability to retrieve the halyard and shackle at the head of a mast of a contemporary sailing vessel from the deck. A clamshell device containing a magnetized component is pre-installed on the halyard shackle and a related magnetically active cylinder is attached to a companion non-loaded halyard running just beside the loaded halyard. The clamshell is attached at the top of the shackle just below the halyard that is attached to the shackle.

The clamshell device of the apparatus of the present invention is generally comprised of a two-part enclosure that is fastened together around the top part of the shackle, one or more permanent magnets of sufficient field strength mounted in opposite pole directions, each of the one or more permanent magnets contacting a thin ferromagnetic rectangular metal component, one pin or screw, and one cotter pin or nut used to ensure the two halves of the clamshell device stay together. The various parts have been dimensioned to allow use with a range of halyard diameters.

The companion non-loaded halyard of the present invention is configured to run in parallel with the loaded halyard. This halyard may be of significantly less strength since the only load seen by this halyard is the combination of the magnetically active cylinder and the shackle from the loaded halyard. Since this is the case, the operating hardware, for example, the pulley at the mast head and the magnetically active cylinder attachment hardware may be of limited strength as well.

In use, a crewmember pre-attaches the clamshell device about the halyard just below the top of the existing sail cringle shackle, then attaches the sail in the normal fashion. A second, smaller diameter non-load bearing retriever halyard is run along the same route as the load bearing shackle. Fastened about this retriever halyard is a ferrous cylinder. If the sail cringle should become detached from the shackle, the crewmember brings the separated shackle to the mast head and secures it. Then, the crewmember attaches a keeper line to the retriever halyard with the ferrous cylinder attached and raises the ferrous cylinder to the mast head. When the ferrous cylinder becomes proximate to the clamshell device, the magnetic force will join them. The crewmember then pulls on the keeper line and retrieves both halyards.

Several embodiments of the present invention are disclosed. Each of these embodiments is dimensioned and constructed to allow use over a broad range of halyard shackle sizes, thus may be used on the vast majority of modern day sailing vessels. Each of the embodiments of the present invention is discussed in detail in conjunction with the drawings listed below. As will be evident, the apparatus and method of the present invention overcomes the disadvantages of the prior art.

DETAILED DESCRIPTION OF PREFERRED EMBODIMENTS

Figure 1:
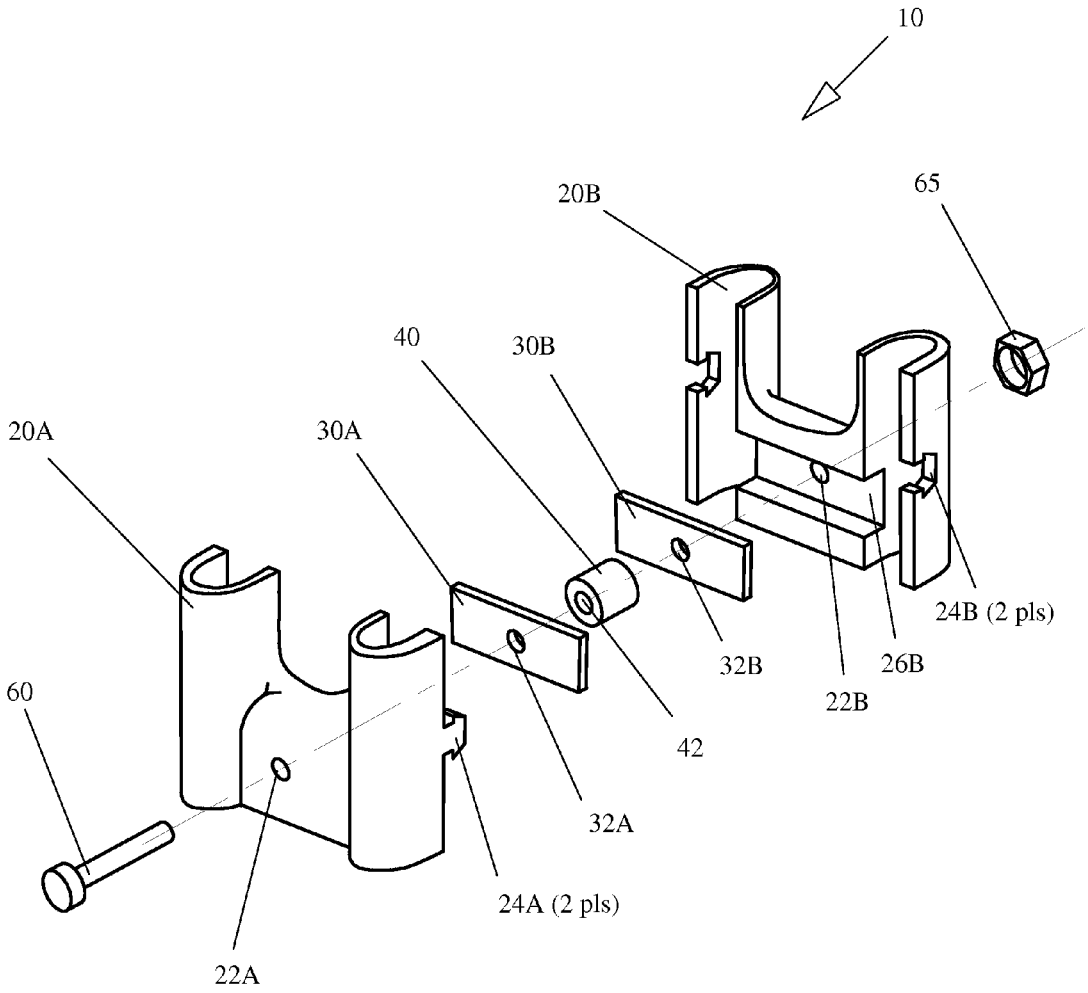
FIG. 1: is an overall exploded isometric view of the clamshell device of the present invention.

As described briefly above, the method and apparatus of the present invention solves the problems associated with prior art loose halyard retrieval. FIG. 1 provides an overview 10 of the clamshell device of the present invention.

The clamshell assembly 10 of the present invention is comprised of two halves 20A and 20B. They are mirror images of each other except for snap tabs 24A and tab slots 24B. In all embodiments the snap tabs 24A and tab slots 24B serve to properly orient the various components of the clamshell assembly 10. In one embodiment the snap tabs 24A and tab slots 24B are used not only for orientation, but also provide the clamping force required to keep the two halves of the clamshell assembly 10 together. In a separate embodiment, a bolt 60 passes through holes 22A, 32A, 42, 32B and 20B, mating with nut 65. The combination of the bolt 60 and the nut 65 provide the requisite clamping force in this embodiment.

The two clamshell halves 20A and 20B are made from a non-ferrous material, for example, polycarbonate. Polycarbonate is the preferred material due to its high impact resistance, ability to withstand weather, and ability to perform in both fresh and salt water environments. As will be clear to those of skill in the art, other materials such as aluminum, polyvinyl chloride or some organic polymer may be used without departing from the spirit of the invention, thus the scope of the invention is limited only by the claims. For the balance of the discussion of the present invention the bolt-fixed embodiment will be used; however, it will be recognized by those of skill in the art that the discussion applies equally to the snap-fixed embodiment.

A permanent magnet 40 is located between ferrous strips 30A and 30B and dimensioned such that when the two halves of the clamshell device 10 are fastened together by bolt 60 and nut 65, the combination of the ferrous strips 30A and 30B and the permanent magnet 40 completely fill the cavities 26A [not shown] and 26B. In a preferred embodiment, permanent magnet 40 is a type DBS-5050 alnico [an alloy of aluminum, nickel and cobalt] from Dura Magnetics, Inc, Sylvania, Ohio. It will be understood that other magnet types, for example neodymium or molybdenum, could be used without departing from the scope of the invention, thus the preferred embodiment is exemplary only. It will be further recognized that the specific dimensions of the preferred embodiment permanent magnet can change depending on the size of the clamshell without departing from the scope of the invention.

Ferrous strips 30A and 30B are identical and are made from B4A2 low carbon steel in a preferred embodiment, but any mild steel of sufficient permeability could be used. Other ferro-magnetic materials, such as carbon fiber infused with iron fillings could also be used while remaining inside the ambit of the claims. Bolt 60 is a ferritic stainless steel bolt of sufficient length to pass through holes 22A, 32A, 42, 32B, and 22B with sufficient thread to fully engage nut 65. Ferritic stainless steel material is used in order to extend the flux lines of permanent magnet 40. Nut 65 is of the nylon insert lock nut type in conventional use and is employed because of its inherent resistance to vibration and weather. Both the nut 65 and the bolt 60 may be obtained from a plurality of sources and are thus not discussed in great detail here. Moreover, while ferritic stainless steel is used in the preferred embodiment, it will be clear that any ferrous bolt and nut could be used.

Figure 2:
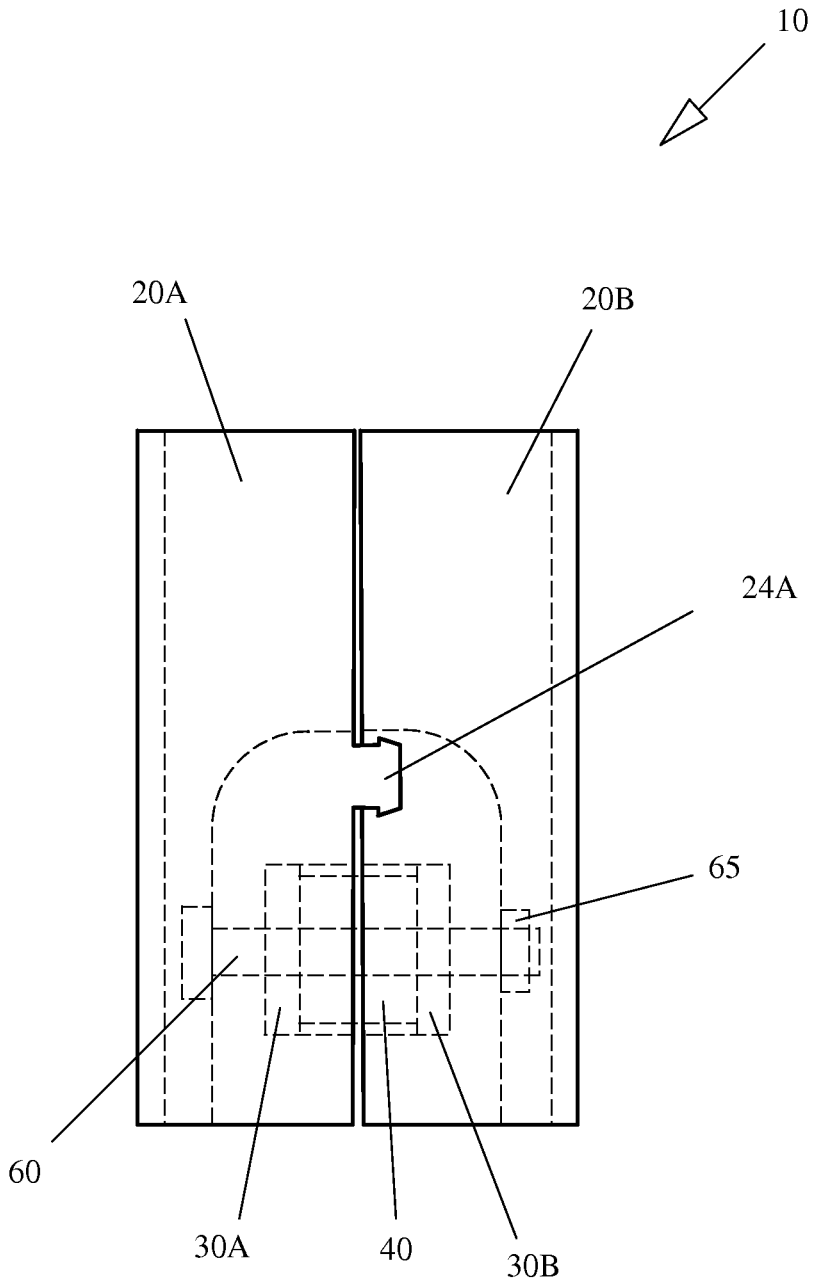
FIG. 2: is a side view of the clamshell device of the present invention showing the relationship of the various parts.

FIG. 2 provides assembly details for the clamshell assembly 10. The two halves of the clamshell assembly 10, 20A and 20B, can be made from a variety of materials including aluminum, plastic or carbon fiber, but as noted above, the preferred embodiment uses polycarbonate. As can be seen, tab 24A snaps into slot 24B [not shown for clarity, but assumed to follow the contours of the tab] and in this embodiment bolt 60 and nut 65 are used to insure that the two halves of the clamshell assembly 10 do not separate. As mentioned above, in an alternative embodiment tabs 24A and slots 24B are configured such that they provide the requisite captive force. In this side view, it can be seen that ferrous strips 30A and 30B in combination with permanent magnet 40 completely fill the cavity formed by the two halves of the clamshell assembly 10.

Figure 3:
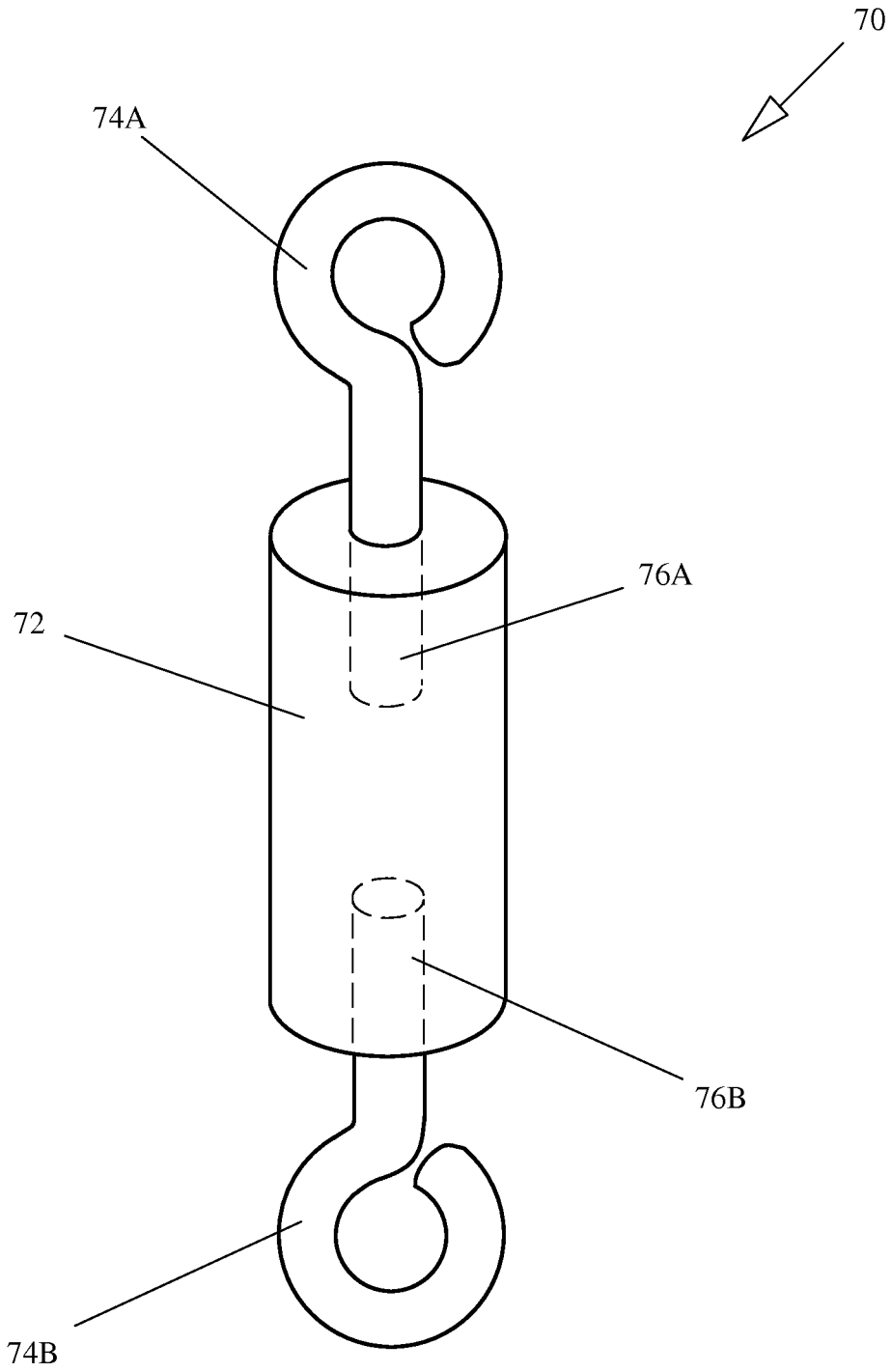
FIG. 3: is a sectional view of the ferrous cylinder assembly of the present invention.

Looking now at FIG. 3, the ferrous cylinder assembly 70 is described in detail. A length of ferrous bar stock 72 of an appropriate diameter has two eye screws 74A and 74B threaded into it. Threads 76A and 76B are of sufficient length to assure that the eye screws 74A and 74B will not be pulled out under the pressure of hauling on the attached non load bearing halyard. The non load bearing halyard discussed briefly above and in detail below in conjunction with FIG. 6 attaches to the ferrous cylinder 72 via eye screws 74A and 74B. Ferrous cylinder 72, eye screw 74A and eye screw 74B are made from B4A2 stock in a preferred embodiment. But as with other ferrous components of the present invention, other ferrous materials may be used without exceeding the scope of the invention.

Figure 4A:
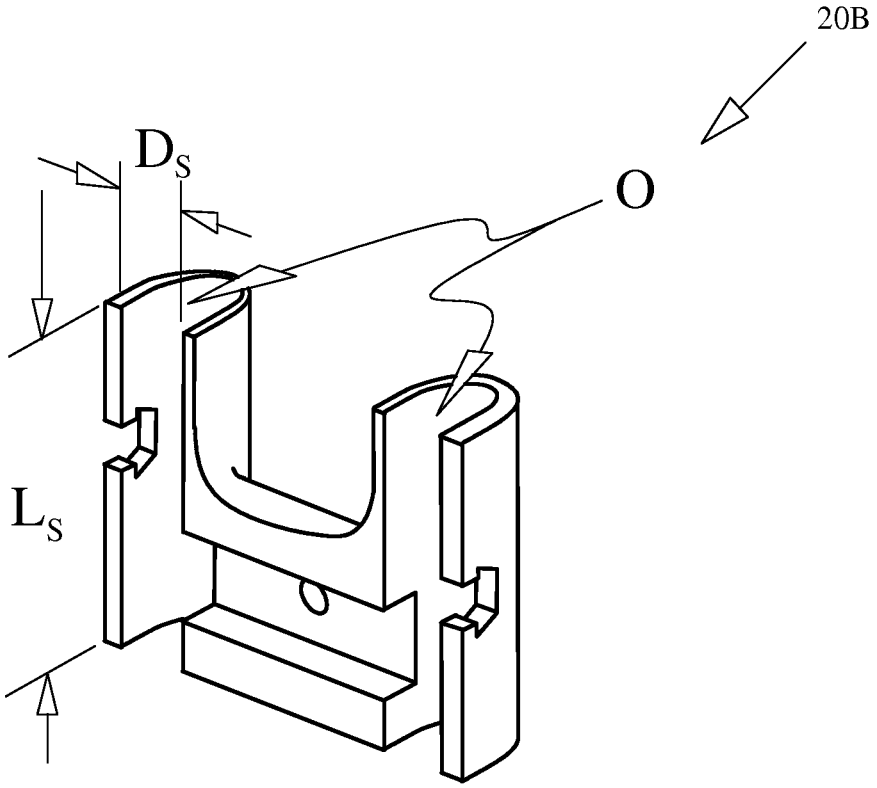
FIG. 4A: is an isometric view of one half of the clamshell device with dimensional annotation.

FIG. 4 provides dimensional details of both the clamshell assembly [10 of FIG. 1] and the ferrous cylinder assembly 70. Note that only one half of the clamshell 20B is shown. It will be understood that the other half will have identical dimensions. Beginning with FIG. 4A, clamshell half 20B has two identical semicircular openings O each with a diameter $D_s$ as shown. Diameter $D_s$ is such that it will easily fit about the upper portion of a common shackle and can be varied to accommodate various shackle shank diameters thereby making the device useful for a wide variety of halyards. By way of example, but not to be read as a limitation, dimension $D_s$ could be any of 0.25 inches, 0.38 inches or 0.50 inches depending on the type of load bearing halyard in use. Other dimensions are equally possible. It should be noted that the actual dimension needed is a function of the type of halyard material, its diameter and other factors specific to the halyard being used.

Dimension $L_s$ in FIG. 4A is chosen to allow the clamshell assembly to easily fit on the upper shanks of a contemporary long reach shackle. Contemporary long reach shackles have a vertical shank length of anywhere from four to eight inches. Dimension $L_s$ is chosen such that it covers just less than half of the vertical shank dimension, thus for a four inch long reach shackle, dimension $L_s$ would be 1.9 inches. This dimension will vary depending on the type of cringle, the weight of the sail and the diameter of the load bearing halyard.

Figure 4B:
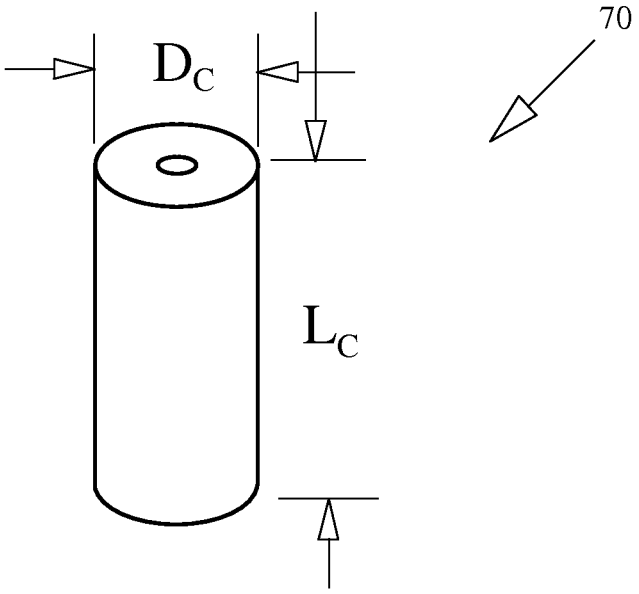
FIG. 4B: is an isometric view of one half of the ferrous cylinder with dimensional annotation.

FIG. 4B provides the dimensional detail of the ferrous cylinder assembly 70. Note that the ferrous cylinder is shown without the eye screws for clarity, but it is understood that the eye screws are implied. Length $L_c$ is chosen to allow the permanent magnet contained in the clamshell device to attract ferrous cylinder assembly 70 over a sufficient vertical range during the retrieval process. By way of example, for the four inch long reach shackle discussed just above, dimension $L_c$ would be 1.9 inches and for an eight inch long reach shackle the dimension $L_c$ would be 3.5 inches.

Dimension $D_c$ in FIG. 4B is selected to allow the ferrous cylinder assembly 70 to fit easily inside the clamshell opening between the semicircles O in FIG. 4A. This is done so that when the ferrous cylinder assembly 70 is being hauled aloft it will have the ability to achieve close proximity to the ferrous strips [32A and 32B of FIG. 1]. Again using the example of a four inch long reach shackle, this dimension would be on the order of 0.75 inches. The dimension needs to be this small in order to accommodate the wall thickness of semicircles O. As with all other dimensions, $D_c$ will vary with the type of cringle, the weight of the sail and the diameter of the load bearing halyard.

Figure 5:
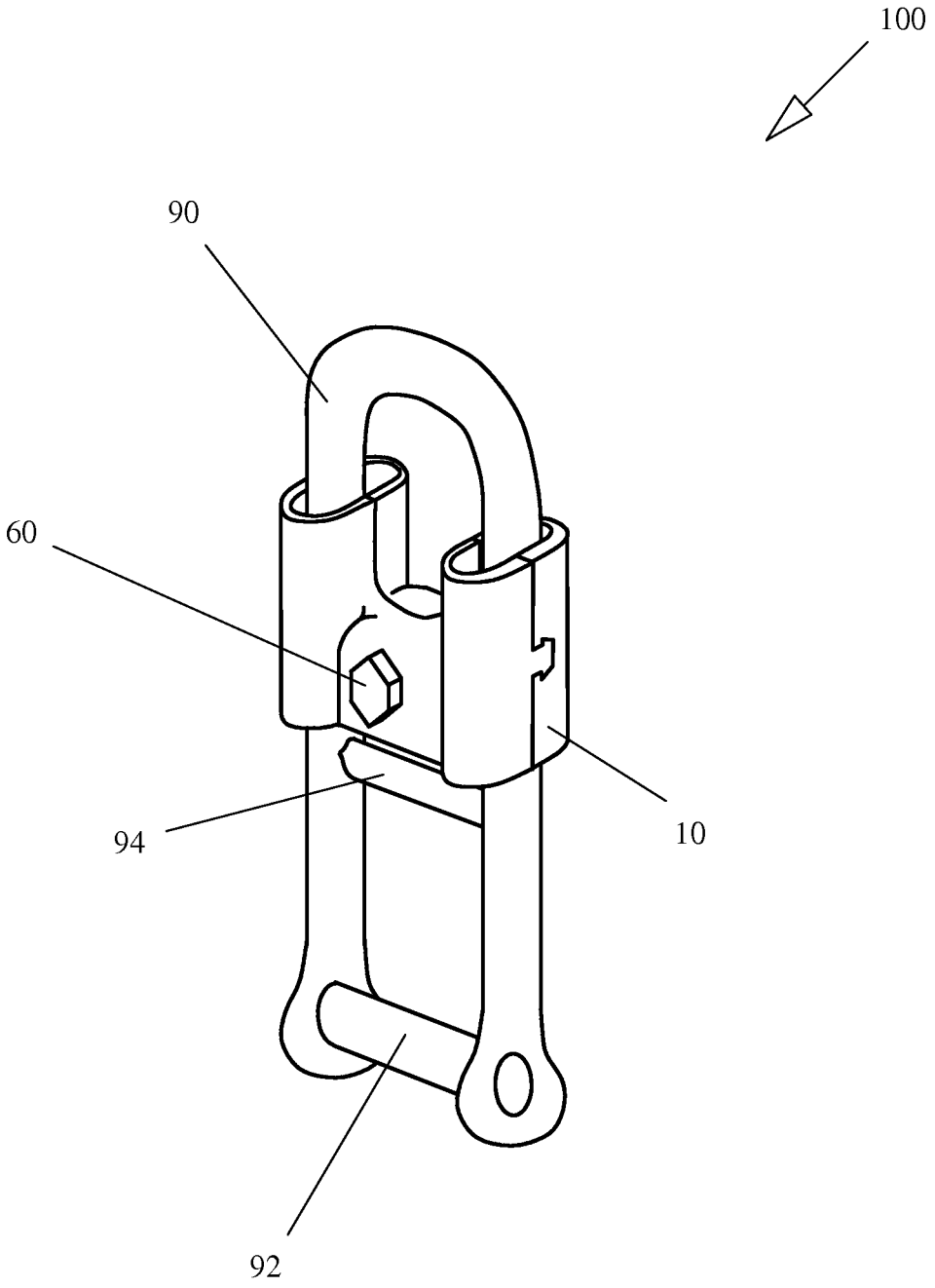
FIG. 5: is an isometric view of the clamshell device attached to a typical shackle.

FIG. 5 shows the assembly 100 of the clamshell assembly 10 of the present invention installed on a typical contemporary long reach shackle 90. On some contemporary long reach shackles a support member 94 is provided at about the halfway point on the vertical shanks of the shackle. The clamshell assembly 10 of the present invention is sized such that it may be used with this type of shackle as well as those shackles that do not have the support member 94. Pin 92 is used to attach the shackle 90 to the cringle of a sail. In this embodiment, bolt 60 is used to both provide the clamping force for the two clamshell halves and to extend the magnetic field of the internal permanent magnet [40 of FIG. 1].

FIG. 6 is a graphical discussion 200 of the method of the present invention. Beginning with FIG. 6A, the sail 80 of a contemporary sailing craft is attached to load bearing halyard 85 by means of shackle 90 via pin 92. The clamshell assembly 10 of the present invention has been properly attached to shackle 90. Non load bearing halyard 75 has been rigged to run in close proximity to halyard 85, following essentially the same route, but is otherwise unloaded during normal operation.

For purposes of this discussion it will be assumed that a purpose-built non load bearing halyard has been run in parallel with the load bearing halyard. It will be recognized that other non load bearing halyards could be used, for example, the topping lift of a sloop rigged vessel could be used rather than a dedicated halyard, and likewise. The spare halyard used to raise and lower a Genoa jib could be used. For purposes of the present invention the term non loaded halyard is general, and is meant to cover all instances of a halyard separate from the one that has had a shackle break free.

Figure 6A:
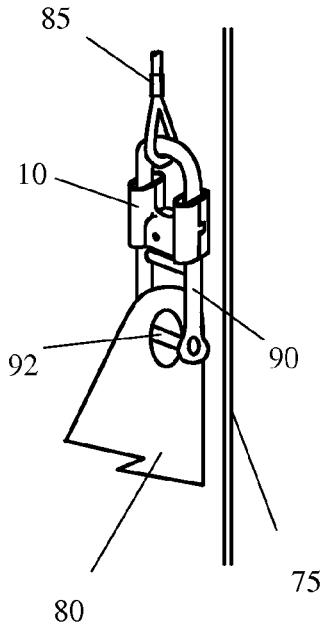
FIG. 6A: shows the initial operating condition of a sail.
Figure 6B:
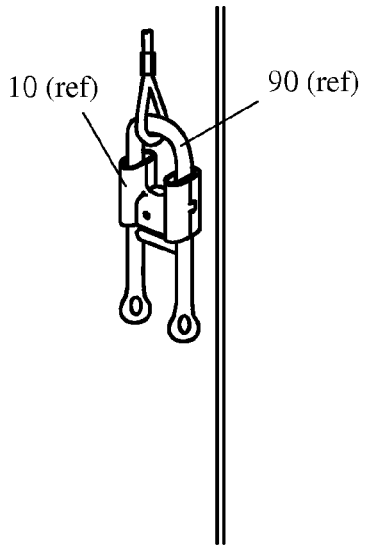
FIG. 6B: shows the condition just after the sail has become detached from its shackle.

In FIG. 6B for some reason the sail has been detached from the shackle 90, in this case by the dislodging of pin 92 (not shown). At this point in time the load bearing halyard, with the clamshell assembly 10 attached, is loose and most likely at the head of the mast due to the weight of the halyard running down to the deck of the sailing craft. If not, a crewmember can up-haul the load bearing halyard until the shackle is at the masthead. This is done to prevent the shackle from whipping about. At this time as well it is likely that the sail that was attached to the shackle 90 has dropped at least part of the way to the deck, making the situation very hazardous.

Figure 6C:
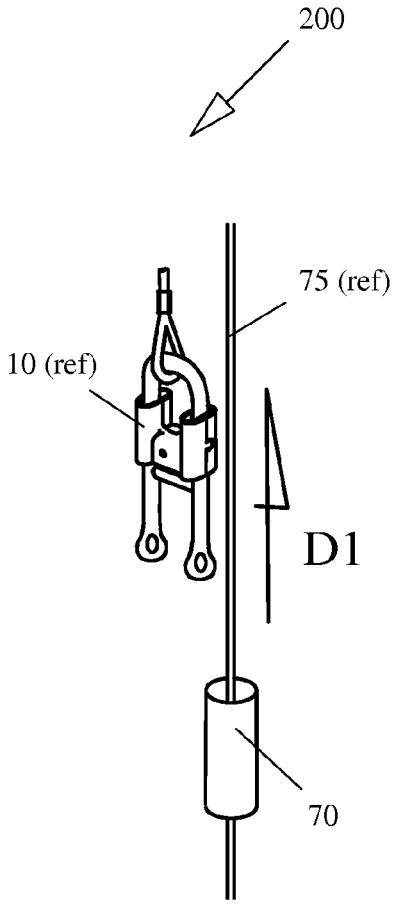
FIG. 6C: shows the non load bearing halyard after having been hoisted aloft.

In FIG. 6C non load bearing halyard 75 has been hoisted aloft as shown by directional arrow D1. In this example the non load bearing halyard is a continuous loop, so no keeper line needs to be attached. However, it is possible to have a non load bearing halyard configured such that a keeper line needs to be attached in order to down haul the non load bearing halyard once it has been hauled aloft. Ferrous cylinder assembly 70 has been hoisted aloft as well since it is snuggly attached to non load bearing halyard 75.

Figure 6D:
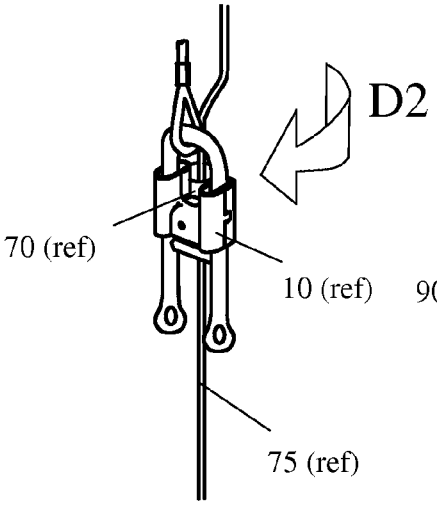
FIG. 6D: shows the capture of the loose shackle.

In FIG. 6D the ferrous cylinder assembly 70 has been forced in direction D2 by the magnetic field of the permanent magnet contained within the clamshell assembly 10. If necessary, this may be accomplished by an easy swinging motion of the non loaded halyard if the inherent magnetic field fails to place the ferrous cylinder assembly 70 close enough to the clamshell assembly 10. Non load bearing halyard 75 is now in very close proximity to clamshell assembly 10 and is held there by the magnetic force of the permanent magnet contained within the clamshell assembly 10.

Figure 6E:
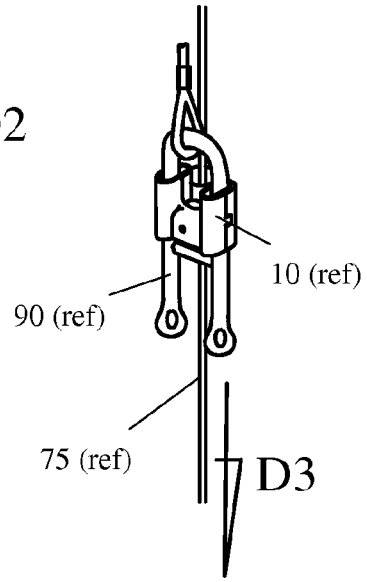
FIG. 6E: shows the loose load bearing halyard being downhauled.

FIG. 6E shows the non load bearing halyard 75 being down-hauled toward the deck by the directional arrow D3. Shackle 90 and clamshell assembly 10 will necessarily be hauled down as well due to the captive force of the permanent magnet in concert with the ferrous cylinder assembly. Once at the deck, the ferrous cylinder assembly 70 and the clamshell assembly 10 may be separated, the sail reattached to shackle 90 and the sail hauled aloft in the normal manner.

In the manner described above, a crewmember is able to retrieve a loose shackle from the deck of a sailing craft without the need to engage in risky and complicated retrieval methods. Moreover, the method of the present invention may be used away from dockside or in rough waters.

A first advantage of the present invention is the ability to retrieve a loose halyard from the deck of a sailing craft. This may be accomplished in the widest range of sailing conditions including dockside or under way.

A second advantage of the present invention is the significant increase in safety to the crew. There is no need to hoist a crewmember aloft, and no need to be casting such devices as grappling hooks about the craft.

A third advantage of the present invention is cost. The clamshell device of the present invention can be manufactured from a variety of materials and is easy to install and use, thus avoid potentially costly repairs in a boatyard.

A fourth advantage of the present invention is its ease of use. A single crewmember can retrieve a disconnected sail in a variety of conditions.

A fifth advantage of the present invention is that it may be used with a wide variety of sails including main sails, jibs, Genoa jibs and gaff rigged booms.

What is claimed is:

1. A remote detached halyard retrieval device comprising:

a clamshell assembly permanently attached to a sail cringle shackle, said sail cringle shackle being disposed at the end of a load bearing halyard, and wherein said clamshell assembly has a magnetic field about it, said magnetic field created by a permanent magnet internal to said clamshell assembly, and;

a ferrous cylinder assembly permanently attached to a non load bearing halyard, said non load bearing halyard being disposed in close proximity to and following essentially the same route as said load bearing halyard and having the ability to be up hauled and down hauled such that said ferrous cylinder assembly may be up hauled placing said ferrous cylinder assembly within the force of said magnetic field causing said ferrous cylinder assembly to be attracted to said clamshell assembly.

2. The clamshell assembly of claim 1 further comprised of:

a first clamshell half, said first clamshell half having a first vertical U-shaped channel, said first vertical U-shaped channel having a male snap tab located centrally along the outer edge of said first vertical U-shaped channel, and a second vertical U-shaped channel, said second vertical U-shaped channel having a male snap tab located centrally along the outer edge of said second vertical U-shaped channel, said first and second vertical U-shaped channels being aligned parallel to each other by a horizontal separator segment, said horizontal separator segment dimensioned such that the centerline of said first and second vertical U-shaped channels of said first clamshell half align with the shanks of a contemporary shackle and having a horizontal channel disposed at a right angle to said first and second vertical U-shaped channels and a through hole located at the geometric center of said horizontal separator segment;

a second clamshell half, said second clamshell half being a mirror image of said first clamshell half and having a first vertical U-shaped channel, said first vertical U-shaped channel having a female snap tab located centrally along the outer edge of said first vertical U-shaped channel, and a second vertical U-shaped channel, said second vertical U-shaped channel having a female snap tab located centrally along the outer edge of said second vertical U-shaped channel, said first and second vertical U-shaped channels being aligned parallel to each other by a horizontal separator segment, said horizontal separator segment dimensioned such that the centerline of said first and second vertical U-shaped channels of said second clamshell half align with the shanks of a contemporary shackle and having a horizontal channel disposed at a right angle to said first and second vertical U-shaped channels and a through hole located at the geometric center of said horizontal separator segment;

a first ferrous strip and a second ferrous strip, each of said ferrous strips dimensioned to fit inside said horizontal channels of said horizontal separator segments and each of said ferrous strips having a through hole at its geometric center;

a permanent magnet, said permanent magnet having a through hole at its geometric center, and;

a ferrous through bolt dimensioned such that said ferrous through bolt passes through said through holes of said first and second clamshell halves, said first and second ferrous strips and said permanent magnet, and;

a ferrous nut having a nylon insert compatible with the threads of said ferrous through bolt such that when said ferrous through bolt is passed through said through holes of said first and second clamshell halves, said first and second ferrous strips and said permanent magnet said ferrous nut generates a clamping force forming said clamshell assembly wherein the magnetic field of said permanent magnet extends to the end of said ferrous through bolt and said ferrous nut.

3. The clamshell assembly of claim 2 wherein the first and second clamshell halves are made from polycarbonate.

4. The clamshell assembly of claim 2 wherein the first and second clamshell halves are made from aluminum.

5. The clamshell assembly of claim 1 wherein the male snap tabs of a first clamshell half mate with the female snap tabs of a second clamshell half providing sufficient clamping force to hold said first and second clamshell halves together such that the ferrous through bolt and ferrous nut are not required.

6. The ferrous strips of claim 2 wherein said ferrous strips are made from B4A2 steel.

7. The permanent magnet of claim 2 wherein said permanent magnet is of alnico composition.

8. The U-shaped channels of claim 2 wherein said U-shaped channels are 0.25 inches in width.

9. The U-shaped channels of claim 2 wherein said U-shaped channels are 0.38 inches in width.

10. The U-shaped channels of claim 2 wherein said U-shaped channels are 0.5 inches in width.

11. The U-shaped channels of claim 2 wherein said U-shaped channels are 1.9 inches in height.

12. The ferrous cylinder assembly of claim 1 further comprised of:

a ferrous cylinder having disposed on a first end a first ferrous eye screw and on a second opposite end a second eye screw, said first and second eye screws having male threads that mate with female threads located at the first and second ends of said ferrous cylinder.

13. The ferrous cylinder of claim 8 wherein said ferrous cylinder is made from B4A2 steel.

14. The ferrous cylinder of claim 13 wherein said ferrous cylinder is 1.9 inches in length.

15. The ferrous cylinder of claim 13 wherein said ferrous cylinder is 0.5 inches in diameter.

16. A method for remotely retrieving a detached halyard comprising:

attaching a clamshell assembly having an internal magnet on the shanks of a contemporary shackle, said contemporary shackle being attached to a load bearing halyard;

attaching said contemporary shackle to the cringle of a sail;

locating a continuous non load bearing halyard in close proximity to said load bearing halyard, said non load bearing halyard having a ferrous cylinder assembly affixed;

up-hauling said ferrous cylinder assembly upon detachment of said contemporary shackle from said cringle using said non loaded halyard such that said ferrous cylinder assembly is placed in close proximity to said clamshell assembly;

allowing the magnetic attraction of said internal magnet in said clamshell assembly to draw said ferrous cylinder assembly and said clamshell assembly together;

down-hauling said non load bearing halyard such that said clamshell assembly is down-hauled with said ferrous cylinder assembly, and;

reattaching said contemporary shackle to said sail cringle.

17. A method for remotely retrieving a detached halyard comprising:

attaching a clamshell assembly having an internal magnet on the shanks of a contemporary shackle, said contemporary shackle being attached to a load bearing halyard;

attaching said contemporary shackle to the cringle of a sail;

locating a non-continuous non load bearing halyard in close proximity to said load bearing halyard, said non-continuous non load bearing halyard having a ferrous cylinder assembly affixed to a first end;

attaching a keeper line to a second end of said non-continuous non load bearing halyard;

up-hauling said ferrous cylinder assembly upon detachment of said contemporary shackle from said cringle using said non-continuous non load bearing halyard, using said keeper line to control said ferrous cylinder assembly such that said ferrous cylinder assembly is placed in close proximity to said clamshell assembly;

allowing the magnetic attraction of said internal magnet in said clamshell assembly to draw said ferrous cylinder assembly and said clamshell assembly together;

down-hauling said keeper line such that said clamshell assembly is down-hauled with said ferrous cylinder assembly, and;

reattaching said contemporary shackle to said sail cringle.

18. The method of claim 16 or 17 wherein the ferrous cylinder is attached to the non-load bearing halyard by means of snaps.

19. The method of claim 16 or 17 wherein the ferrous cylinder is attached to the non-load bearing halyard by means of knots.

20. The method of claim 16 or 17 wherein the ferrous cylinder is attached to the non-load bearing halyard by means of strain relief eyelets.

* * * * *